US010424287B2

(12) United States Patent
Guiu et al.

(10) Patent No.: US 10,424,287 B2
(45) Date of Patent: Sep. 24, 2019

(54) ACTIVE NOISE-CONTROL DEVICE

(71) Applicant: OROSOUND, Saint Maur des Fosses (FR)

(72) Inventors: Pierre Guiu, Clamart (FR); Eric Benhaim, Saint Maur des Fosses (FR)

(73) Assignee: OROSOUND, Saint Maur des Fosses (FR)

( * ) Notice: Subject to any disclaimer, the term of this patent is extended or adjusted under 35 U.S.C. 154(b) by 0 days.

(21) Appl. No.: 15/743,263

(22) PCT Filed: Jul. 22, 2016

(86) PCT No.: PCT/EP2016/067590
§ 371 (c)(1),
(2) Date: Jan. 9, 2018

(87) PCT Pub. No.: WO2017/017038
PCT Pub. Date: Feb. 2, 2017

(65) Prior Publication Data

US 2018/0197527 A1 Jul. 12, 2018

(30) Foreign Application Priority Data

Jul. 24, 2015 (FR) ..... 15 57050

(51) Int. Cl.
*G10K 11/178* (2006.01)

(52) U.S. Cl.
CPC ..... *G10K 11/17823* (2018.01); *G10K 11/178* (2013.01); *G10K 11/17837* (2018.01);
(Continued)

(58) Field of Classification Search
CPC ..... H04R 1/1016; H04R 1/1091; H04R 2460/01; H04R 3/005; H04R 2460/05; H04R 1/105; H04R 1/1075; H04R 25/02; H04R 3/002; H04R 3/02; H04R 1/323; H04R 2430/01; H04R 2499/11; H04R 3/12; H04R 1/10; H04R 25/00; G10L 19/08; G10L 19/12; G10L 19/26; G10L 21/0208; G10L 21/0224; G10L 21/0232;
(Continued)

(56) References Cited

U.S. PATENT DOCUMENTS 6,160,448 A * 12/2000 Werrbach ..... H03F 3/211 254/278
8,737,636 B2 * 5/2014 Park ..... G10K 11/178 381/71.1
(Continued)

FOREIGN PATENT DOCUMENTS

WO WO 02/17837 A1 3/2002

*Primary Examiner* — Lun-See Lao
(74) *Attorney, Agent, or Firm* — Muncy, Geissler, Olds & Lowe, P.C.

(57) ABSTRACT

Disclosed is an active-noise control device including two passive attenuation earphones each provided with an external microphone, an internal microphone and a loudspeaker. The control device includes a first processing chain having a feedforward filter, a feedback filter and a reconstruction module. The control device includes a second processing chain having a sound source identification module, said second processing chain being implemented in parallel with the first processing chain, and being suitable for parameterizing the first processing chain.

5 Claims, 3 Drawing Sheets

(52) U.S. Cl.
CPC ..... *G10K 11/17881* (2018.01); *G10K 2210/1081* (2013.01); *G10K 2210/111* (2013.01); *G10K 2210/3026* (2013.01); *G10K 2210/3027* (2013.01); *G10K 2210/30231* (2013.01); *G10K 2210/3215* (2013.01); *G10K 2210/3222* (2013.01); *G10K 2210/3224* (2013.01); *G10K 2210/509* (2013.01)

(58) Field of Classification Search
CPC ..... G10L 25/21; G10L 25/78; G10L 25/93; H04K 1/02; H04K 2203/12; H04K 3/43; H04K 3/45; H04K 3/825; G10K 11/002; H04B 7/1858
USPC .... 381/309, 74, 66, 71.11–71.14, 71.1–71.6, 381/94.1–94.4, 92, 56–59; 700/94
See application file for complete search history.

(56) References Cited

U.S. PATENT DOCUMENTS

| | | | | |
|---|---|---|---|---|
| 2009/0147966 | A1* | 6/2009 | McIntosh ..... | H04R 3/005 381/71.11 |
| 2010/0131269 | A1 | 5/2010 | Park et al. | |
| 2011/0007907 | A1 | 1/2011 | Park et al. | |
| 2011/0293103 | A1 | 12/2011 | Park et al. | |
| 2012/0215519 | A1* | 8/2012 | Park ..... | G06F 17/289 704/2 |
| 2014/0247948 | A1* | 9/2014 | Goldstein ..... | H04R 1/1016 381/58 |

* cited by examiner

Zoom A

ACTIVE NOISE-CONTROL DEVICE

BACKGROUND OF THE INVENTION

Numerous people work in noisy environments in which they are exposed to very high levels of noise coming from a variety of sources. Such noisy environments are to be found for example on building sites, on demolition sites (dynamiting), in factories using machine saws, etc. In such noisy environments, it is necessary to reduce noise levels in order to protect the hearing of such people.

Other people work in noisy environments in which noise levels exist in continuous manner that are lower, thereby presenting a smaller risk in the short term of deteriorating hearing capacity, but tending to increase fatigue and stress, and to reduce the capacities of such people for attention and concentration. Such noisy environments are to be found for example in open work spaces as used in call centers. The level of noise needs to be attenuated in order to improve the working conditions of such people.

Other people, in a non-professional setting, also desire to reduce the levels of noise in their environment in order to improve their own comfort, e.g. when they seek to rest, to concentrate (in order to read), or indeed when they desire to benefit fully from music they are listening to.

In most such situations, it is important to reduce noise levels effectively, but it can also be most advantageous to avoid complete acoustic isolation of the person in question so as to allow that person, while still being effectively protected against undesirable noise, to perceive useful noises: voices, alarms, doorbells, etc. In other words, it is very advantageous to adapt the level of noise attenuation as a function of the type of the noise, and possibly also as a function of the level of the noise, of the type of outside environment, etc.

Certain hearing protection devices are provided with noise control systems that make it possible to attenuate noise in different manners depending on the level of the noise.

For example, headsets are known that are dedicated to providing protection against the loud noises produced by an impact or an explosion. Such headsets are used mainly to attenuate the noise of shooting guns. They limit the noise of shots while still allowing the user to hear sounds of lower level. Such headsets include two earpieces, each generally comprising a shell, a microphone, and a loudspeaker. The shell comprises material of high density that gives a very large amount of passive attenuation. The microphone picks up surrounding noise outside the shell and plays back a filtered signal so that sounds that do not exceed a certain predefined threshold (typically 88 A-weighted decibels (dB (A))) are transmitted to a loudspeaker that then plays them back to the user's ear. By way of example, the user can thus hear voice sounds, while the sounds of shots are smothered.

Intra-auricular earphones are also known that operate in similar manner to the above-described headsets and that are particularly adapted to protecting a user against loud noises such as those encountered during building work or in particularly noisy industrial environments (e.g. see Document U.S. Pat. No. 5,355,418).

Such headsets and earphones thus adapt the way noise is controlled to the level of external noise, but not to the type of external noise. They therefore do not make it possible to attenuate an undesirable noise while amplifying a useful noise in a noisy environment in circumstances where the useful noise and the undesirable noise present equivalent sound levels.

OBJECT OF THE INVENTION

An object of the invention is to provide active noise control that is effective and that can adapt to the type of the noise.

SUMMARY OF THE INVENTION

In order to achieve this object, there is provided an active noise control device comprising two passive attenuation earpieces, each having an external microphone, an internal microphone, and a loudspeaker for playing back a noise into the earpiece. The control device has a first processing channel comprising a feedforward filter connected to the external microphones, a feedback filter connected to the internal microphones, and a playback module supplying each loudspeaker with a playback signal derived from the output signals of the feedforward filter and of the feedback filter. The control device includes a second processing channel comprising a sound source identification module for identifying sound sources, the second processing channel being implemented in parallel with the first processing channel and being adapted to adjust the settings of the first processing channel.

The sound source identification module enables the control device to perform active noise control that can be adapted to the type of the external noise. Implementing the second processing channel having the identification module in parallel with the first processing channel makes it possible to improve the effectiveness of the active noise control.

Other characteristics and advantages of the invention appear on reading the following description of a particular non-limiting embodiment of the invention.

BRIEF DESCRIPTION OF THE DRAWINGS

Reference is made to the accompanying drawings, in which.

DETAILED DESCRIPTION OF THE INVENTION

Figure 1:
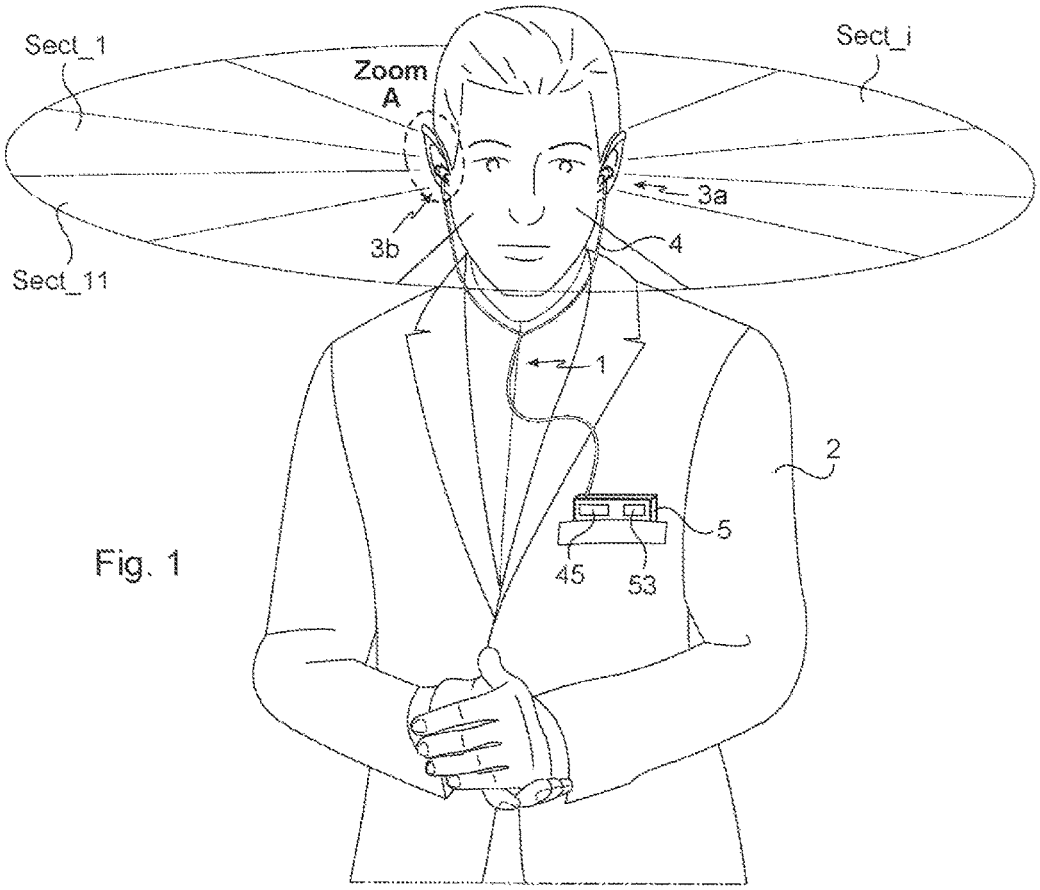
FIG. 1 shows a user situated in a noisy environment and provided with an active noise control device of the invention.

With reference to FIG. 1, the active noise control device 1 in accordance with the invention is for wearing by a user 2 situated in a noisy environment (work space, etc.).

The control device 1 serves to improve the user's access to a noise referred to as "useful" noise that exists in the noisy environment, while attenuating as much as possible noise that is referred to as "undesirable" noise that also exists in the noisy environment.

As can be seen from the description below, the term "useful" noise is used herein to mean a particular type of noise having a particular amplitude and coming from a particular direction in three-dimensional space.

The control device 1 also enables the user 2 to listen to music. This function is mentioned very briefly below in the present description, since it does not constitute the core of the invention.

The control device 1 comprises a left passive attenuation earpiece 3*a* and a right passive attenuation earpiece 3*b*, each connected by a cable 4 to a unit 5 located in this example in a jacket pocket of the user 2. Each cable 4 comprises a plurality of conductor wires surrounded by a protective sheath, the conductor wires being for conveying various analog and digital electrical signals that are mentioned below and that pass between each of the earpieces 3 and the unit 5.

Figure 2:
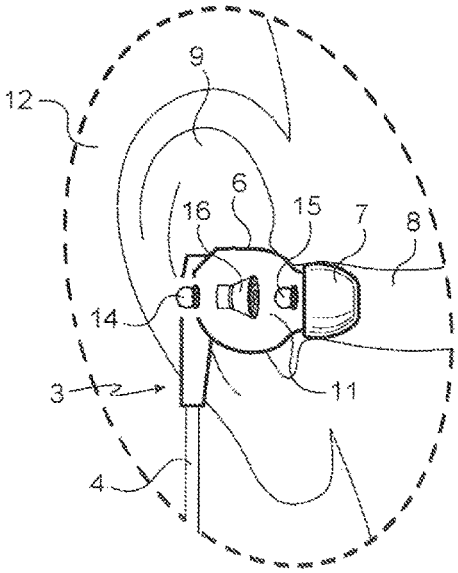
FIG. 2 is a detail view of FIG. 1 showing an earpiece of the control device of the invention.

With reference to FIG. 2, each earpiece 3 in this example is in the form of an intra-auricular earphone that comprises a body 6 and a tip 7 carried by the body 6.

The tip 7 is of a shape that is appropriate for enabling the tip 7 to be inserted into the auditory canal 8 of an ear 9 of the user 2, closing off said auditory canal. The tip 7 holds the earpiece 3 in the auditory canal 8 of the ear 9 and provides the user 2 with passive sound attenuation by producing sound isolation.

Each body 6 defines an internal acoustic space 11 extending facing the inside of the auditory canal 8 and also defines an external acoustic space 12 extending outside the earpiece 3.

Each earpiece 3 also includes an external microphone 14, an internal microphone 15, and a loudspeaker 16 that are fitted to the body 6 of the earpiece 3.

The external microphone 14 is mounted on the body 6 outside the internal acoustic space 11 in order to pick up an external noise that exists in the external acoustic space 12 and produce an external electric signal representative of the external noise. The external electric signal of each earpiece 3 is transmitted to the unit 5 via the cable 4 connecting the earpiece 3 to the unit 5.

The internal microphone 15 is mounted in the body 6 to pick up internal noise that exists in the internal acoustic space 11 and to produce an internal electric signal representative of the internal noise. The internal electric signal of each earpiece 3 is transmitted to the unit 5 via the cable 4 connecting the earpiece 3 to the unit 5.

The loudspeaker 16 is positioned in such a manner as to play a noise back into the internal acoustic space 11 and thus into the auditory canal 8 of the ear 9, which noise is played back from a playback signal produced by the unit 5 and sent by the unit 5 to each earpiece 3 via the cable 4 connecting the earpiece 3 to the unit 5.

The unit 5 includes a circuit card having a plurality of electronic components mounted thereon constituting processor means 20.

Figure 3:
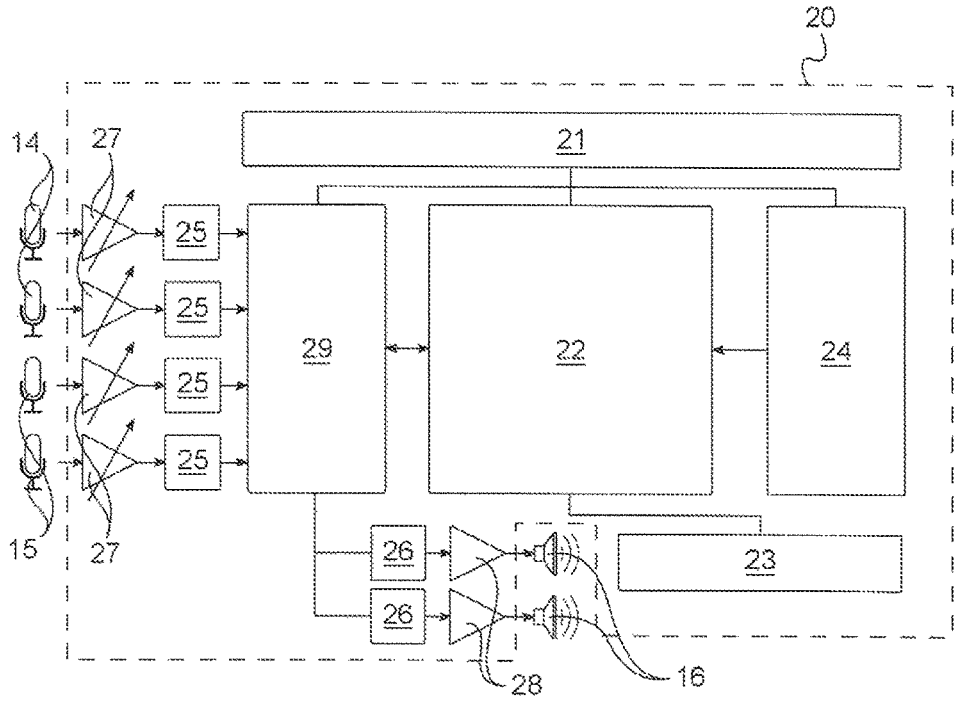
FIG. 3 is a circuit diagram of processor means of the control device of the invention.

With reference to FIG. 3, the processor means 20 comprise a power supply module 21, a microcontroller 22, a clock module 23, an audio source module 24, four analog-to-digital converters 25, two digital-to-analog converters 26, first analog interface components 27, second analog interface components 28, and a digital signal processor (DSP) 29.

The power supply module 21 in this example comprises a rechargeable battery and a power supply circuit that serves in particular to manage the charge in the battery and that delivers one or more power supply voltages to the circuit card and to the earpiece 3 via the cable 4 in order to power the electric components of the card and the earpieces 3.

The microcontroller 22 and the DSP 29 manage the operation of the circuit card, and more broadly of the control device 1 overall.

The clock module 23 includes a clock component (quartz, etc.) used for clocking the operations of the microcontroller 22, and thus the operations of the other components (analog-to-digital converter 25, etc.).

The audio module 24 enables the user to listen to music. The audio source module 24 acquires music signals which, in this example, are transmitted to the unit 5 by a telephone via a Bluetooth-type wireless call. In turn, the microcontroller 22 receives the music signals and sends the music signals to the earpieces 3 via the cables 4 so that the loudspeakers 16 in the earpieces 3 play back the music into the internal acoustic space 11 of each earpiece 3.

The analog-to-digital converters 25 convert into digital signals the external electric signals and the internal electric signals that are produced in the form of analog signals respectively by the external microphones 14 and by the internal microphones 15. Likewise, the digital-to-analog converters 26 convert into analog signals the playback signals and the music signals that are produced by the microcontroller 22 in the form of digital signals.

The first components of the analog interface 27 shape (i.e. amplify, attenuate, filter, etc.) the external electric signals and the internal electric signals that are produced respectively by the external microphones 14 and the internal microphones 15 in the form of analog signals prior to those signals being converted into digital signals by the analog-to-digital converters 25. Likewise, the second analog interface components 28 shape (i.e. amplify, attenuate, filter, etc.) the playback signals and the music signals after they have been converted into analog signals by the digital-to-analog converters 26.

There follows a description in greater detail of the processing performed by the control device 1.

Figure 4:
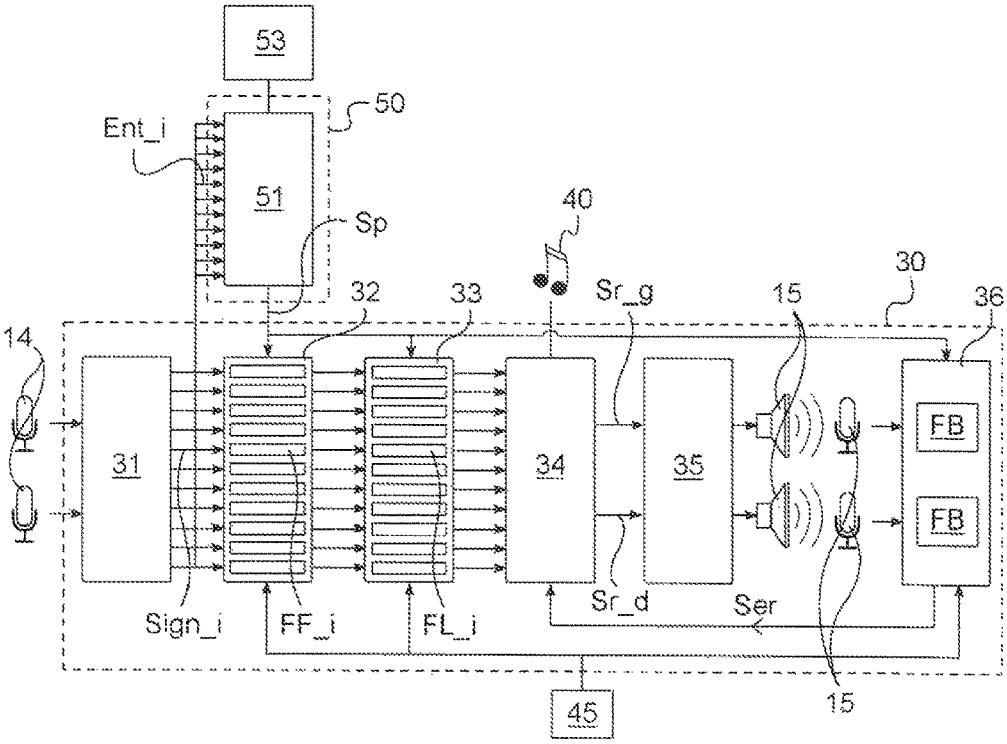
FIG. 4 shows a first processing channel and a second processing channel of the control device of the invention.

With reference to FIG. 4, a first processing channel 30 is implemented by the microcontroller 22 and the DSP 29 of the processor means 20 of the unit 5.

The first processing channel 30 comprises the following functional blocks connected in series and arranged in succession from upstream to downstream in the first processing channel 30 (i.e. from the inputs to the outputs of the first processing channel 30): a partitioning module for partitioning the external acoustic space 31, a feedforward module 32, a limiter module 33, a playback module 34, an amplifier module 35, and a feedback module 36.

The module 31 for partitioning the external acoustic space receives as inputs the external signals that are produced by the external microphone 14 of the left earpiece 3*a* and by the external signal produced by the external microphone 14 of the right earpiece 3*b*. The module 31 for partitioning the external acoustic space combines the external signals produced by the external microphone 14 of the left earpiece 3*a* and the external signal produced by the external microphone 14 of the right earpiece 3*b* to form a directional microphone.

Figure 5:
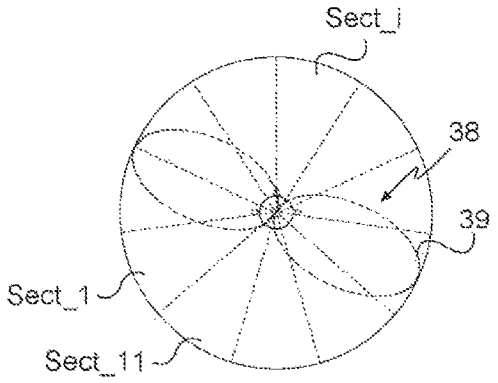
FIG. 5 is a radiation pattern for a directional microphone constituted by external microphones of the control device of the invention.

The directional microphone presents a radiation pattern of directivity that is determined by the weighting coefficients and by the delay coefficients used in combining each of the external signals. The directional microphone that is formed in this example has a directional radiation pattern 38 as shown in FIG. 5 that constitutes a radiation pattern of the first order bidirectional broadside type.

By varying the direction of the main lobe 39 of the directional radiation pattern 38 of the directional microphone, eleven directional microphones are defined in this example in respective different directions. The external acoustic space is thus partitioned into eleven incidence sectors Sect_i (visible in FIG. 1 and in FIG. 5, where i varies over the range 1 to 11), which sectors are defined in a horizontal plane containing the external microphones 14. Thereafter, eleven directional external signals Sign_i are defined, each corresponding to a directional external noise coming from a respective one of the eleven incidence sectors Sect_i.

Each of the eleven directional external signals Sign_i is processed separately by the feedforward module 32 and by the limiter module 33.

The feedforward module 32 has eleven feedforward filters FF_i, each filtering a respective one of the eleven directional external signals Sign_i. Each feedforward filter FF_i operates on the known principle of open-loop anticipatory control (not described herein).

Thus, the feedforward filter FF_i is adapted either to attenuate or else to amplify the directional external noise from the incidence sector Sect_i, and to do so to a greater or lesser extent as a function of feedforward settings of the filter FF_i. If the directional external noise is a useful noise, the corresponding directional external signal Sign_i is amplified by the corresponding feedforward filter FF_i (or else is forwarded unchanged). In contrast, if the directional external noise is undesirable noise, the corresponding directional external signal Sign_i is attenuated by the corresponding feedforward filter FF_i.

Each feedforward filter FF_i is typically capable of maximum attenuation of about 20 decibels (dB) for directional external noise having a frequency lying in the range 50 hertz (Hz) to 2 kilohertz (kHz).

The limiter module 33 has eleven limiter filters FL_i, each receiving an output signal from one of the eleven feedforward filters FF_i.

Each limiter filter FL_i is arranged to limit the output signal from the associated feedforward filter FF_i so as to ensure that the noise played back in the internal acoustic space 11 and thus in the auditory canal 8 of each ear 9 of the user 2 does not have a sound level that is too great. The limiter filters FL_i thus serve to protect the hearing of the user 2 against noise at a high sound level.

In order to limit the output signal from the feedforward filter FF_i, the limiter filter FL_i allows frequency components of the output signal from the feedforward filter FF_i to pass, providing they are of amplitude that is below a limit threshold, and it cuts off those frequency components of amplitude that is greater than the limit threshold to the limit amplitude.

The playback module 34 receives the eleven output signals from the limiter module 33 and recombines them, while taking account of the incidence sectors Sect_i from which they come, so as to comply with the partitioning of the external acoustic space 12. The playback module 34 also receives the above-mentioned music signals 40.

The playback module 34 mixes the combined eleven output signals from the limiter module 33 and the music signals 40, and it produces a left playback signal Sr_g and a right playback signal Sr_d that comply with the binaural reception of the user 2.

The left playback signal Srg and the right playback signal Srd form a stereo signal that is amplified by the amplifier module 35 and that is sent to the loudspeaker 16 of the left earpiece 3*a* and to the loudspeaker 16 of the right earpiece 3*b* via the cables 4.

The loudspeaker 16 of the left earpiece 3*a* and the loudspeaker 16 of the right earpiece 3*b* then play back a playback noise respectively into the internal acoustic space 11 of the left earpiece 3*a* and into the internal acoustic space 11 of the right earpiece 3*b* of the user 2.

Each internal microphone 15 picks up the internal noise in the internal acoustic space 11 of the earpiece 3 and produces an internal electric signal representative of the internal noise.

The feedback module 36 has two feedback filters FB. Each feedback filter FB receives the internal electric signal from one of the internal microphones 15 and isolates the residual electric signal corresponding to a residual noise for attenuation that exists in the internal acoustic space 11. The residual noise is constituted by the combination of the noise that the earpieces 3 allow to pass into the internal acoustic space 11 and the physiological noise transmitted to the auditory canal by bone conduction.

The feedback filters FB then produce an opposite residual electric signals Ser and transmit the opposite residual signal Ser to the playback module 34 so that the playback module 34 generates opposite corrective noise having the same gain and in phase opposition relative to the residual noise.

This serves to attenuate residual noise, in particular by obtaining maximum attenuation of the order of 30 dB for low frequency components of the residual noise lying in the range 10 Hz to 1 kHz.

The feedback module 36 is thus adapted to attenuate the external noise and to do so to a greater or lesser extent as a function of the feedback settings of the feedback filter FB.

As described above, the first processing channel 30 operates by using adjustment settings constituted by the feedforward settings of the process filters FF_i, the feedback settings of the feedback filters FB, and the limit thresholds of the limit filters FL_i.

The feedforward settings, the feedback settings, the limit thresholds, and the passive attenuation provided by the earpieces 3 contribute to a total gain of the control device 1. The total gain of the control device 1 may be total amplification or total attenuation.

The control device 1 has first adjustment means implemented in the processor means 20 that serve to adjust in combined manner the limit thresholds of the limit filters FL_i, the feedforward settings of the feedforward filters FF_i, and the feedback settings of the feedback filters FB of the first processing channel 30 (and thus the total gain of the control device 1).

The unit 5 of the control device 1 has a first user interface 45 (visible in FIG. 1) enabling the user 2 of the control device 1 to control the first adjustment means. In this example, the first user interface 45 comprises a potentiometer and one or more adjustment buttons.

The first adjustment means enable the user 2 to select whether the total gain is total attenuation or total amplification.

When the user 2 selects total attenuation, the user 2 can adjust a total attenuation level that is greater than or less than the passive attenuation provided by the earpieces 3 themselves.

Figure 6:
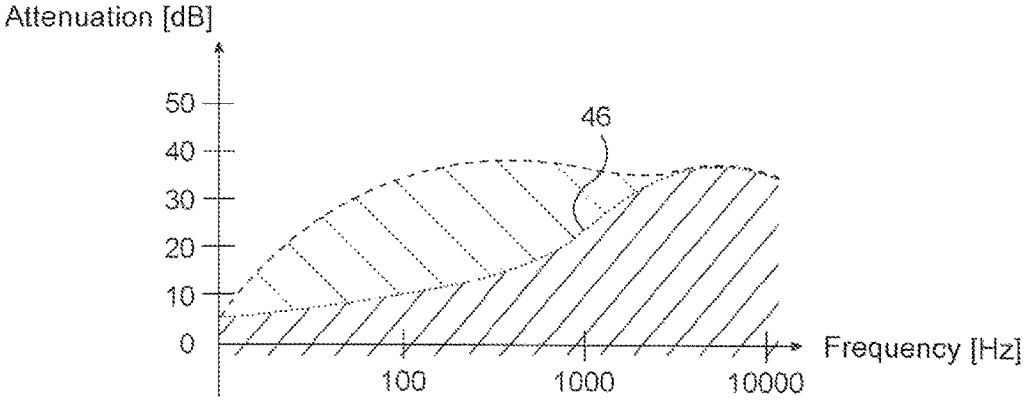
FIG. 6 is a graph plotting a curve for passive attenuation and a curve for combined passive and active attenuation of the control device of the invention.

With reference to FIG. 6, when the total attenuation level is greater than the passive attenuation 46, which corresponds to the zone shaded in dotted lines, the first processing channel 30 needs to produce additional attenuation in order to reach the total attenuation level.

This situation occurs in particular when the directional external noise is unwanted noise that needs to be attenuated strongly.

The feedforward settings and the feedback settings are adjusted so that the feedforward filter FF_i concerned and the feedback filters FB provide the additional attenuation.

The first adjustment means include means for activating the limit filters FL_i, and in this situation, they deactivate the limit filter FL_i in question. The feedforward filter FF_i and the feedback filter FB are then used, via an appropriate adjustment of the feedback settings and the feedforward settings to limit the directional external signal Sign_i. This limit is additional to the passive attenuation supplied by the earpieces 3 and serves to avoid the playback noise having a sound level that is too great. The hearing of the user 2 it thus protected passively by the earpieces 3 and actively by the feedforward filter FF_i and the feedback filters FB when the limit filter FL_i is deactivated.

When the total gain is total attenuation that is less than the passive attenuation 46, which corresponds to the zone shaded in continuous lines in FIG. 6, the first processing channel 30 needs to amplify the noise in order to reduce the passive attenuation provided by the earpieces 3.

Likewise, when the total gain is total amplification, corresponding to the zone shaded in continuous lines in FIG. 6 situated below the abscissa axis, the first processing channel 30 needs to amplify the noise to cancel the effect of the passive attenuation and provide additional amplification.

These two situations occur in particular when the directional external noise is useful noise, such as speech, that the user 2 seeks to amplify or at least to listen to while reducing the impact of the passive attenuation produced by the earpieces 3. The directional external signal Sign_i is then forwarded unchanged or with amplification in a frequency band that lies typically in the range 50 Hz to 8 kHz.

The feedforward settings are adjusted so that the feedforward filters FF_i perform the total amplification.

The means for activating the limit filters FL_i in such situations activate the limit filter FL_i in question. Protecting the hearing of the user 2 against noise having a large sound level is thus performed passively by the earpieces 3 and actively by the limit filter FL_i.

In both of these situations, it should be observed that the limit threshold is adjusted as a function of the total gain: the greater the amplification provided by the first processing channel, the higher that limit threshold. Thus, noise having a large sound level is limited in proportion to the adjustment of the total gain performed by the user 2. Beyond a certain total gain, the limit threshold no longer varies, and it is then fixed at maximum level in order to preserve the user's ears.

With reference once more to FIG. 4, a second processing channel 50 may be implemented by the microcontroller 22 and the processor means 20 in the unit 5.

The second processing channel 50 includes an identification module 51 for identifying sound sources.

The identification module 51 has eleven identification inputs Ent_i and a settings output Sp.

Each identification input Ent_i is connected to the module 31 for partitioning the external acoustic space and receives one of the eleven directional external signals Sign_i, each corresponding to directional external noise coming from a respective one of the eleven incidence sectors Sect_i.

The settings output Sp is connected to the feedforward module 32, to the limit module 33, and to the feedback module 36.

The identification module 51 is suitable for setting the first processing channel 30 via the settings output Sp by applying settings to the feedforward module 32 (and thus adjusting the feedforward settings), to the limit module 33 (and thus adjusting the limit thresholds), and to the feedback module 36 (and thus adjusting the feedback settings).

The control device 1 has second adjustment means implemented in the processor means 20 for adjusting the identification module 51. The unit 5 of the control device 1 has a second user interface 53 enabling the user 2 of the control device 1 to control the second adjustment means.

The identification module 51 operates as follows.

By means of the second user interface 53, the user can select a type of useful noise (speech, alarm, etc.), first incidence sectors Sect1, and second incidence sectors Sect2, from the eleven incident sectors Sect_i.

The identification module 51 attenuates strongly or totally any directional external noise coming from the second incidence sectors Sect2.

The identification module 51 identifies whether the directional external noise coming from each first incidence sector Sect1 is useful noise, as a function of the choices made by the user. The type of the directional external noise is identified on the basis of a plurality of parameters extracted from spectral and time contents of the directional external signal Sign_i.

If the directional external noise is useful noise, the identification module 51 sets the first processing channel 30 so that the total gain of the control device 1 is total amplification, or else total attenuation less than the passive attenuation. The total gain level is adjusted via the first adjustment means.

If the directional external noise is undesirable noise, the identification module 51 sets the first processing channel 30 so that the total gain of the control device is strong total attenuation.

It should be observed that the processing performed by the first processing channel 30 and the processing performed by the second processing channel 50 is performed in parallel, i.e. the identification module 51 of the second processing channel 50 identifies the useful type of noise in the first incidence sectors Sect_1, while the first processing channel 30 processes all of the directional external signals Sign_i of the eleven incidence sectors Sect_i.

The settings established by the second processing channel 50 naturally have priority over the settings established via the first adjustment means. If the user 2 selects an incidence sector Sect_i as being a second sector Sect2, all directional external noise coming from that incidence sector is strongly attenuated regardless of the adjustment produced by using the first adjustment means.

The feedforward settings, the feedback settings, and the limit thresholds of the first processing channel 30 thus vary dynamically as a function of the processing performed by the second processing channel 50 (and naturally as a function of adjustments made by the user 2 via the first adjustment means and the second adjustment means).

The active noise control performed by the first processing channel 30 and by the second processing channel 50 in parallel is thus not only more reactive, but also considerably more effective. Specifically, the processing performed by the first processing channel 30 has very little latency, typically about fifty microseconds for the feedforward filters FF_i, whereas the noise identification performed by the second processing channel 50 requires longer calculation time, typically lying in the range one millisecond to ten milliseconds. The first processing channel 30 is therefore not subject to delay that would be harmful both for the processing performed (e.g. for the open-loop anticipatory control performed by each of the feedforward filters), and also for playing back a useful noise that must not suffer excessive delay.

The invention is not limited to the particular embodiment described above, but on the contrary covers any variant coming within the ambit of the invention as defined by the claims.

Although an active noise control device is described above that has two earpieces connected by cables to a remote unit, it is entirely possible to replace the cables with wireless transmission (WiFi, etc.), to incorporate the processor means of the unit in the earpieces (or in only one of the earpieces), to incorporate the processor means of a plurality of control devices in a remote server communicating with the earpieces over a wireless link, etc. The two earpieces may together form a headset with a mechanical connection element (headband), and need not be in the form of intra-auricular earphones, but rather in the form of intra-concha, circum-aural, supra-aural, etc. devices.

Although it is stated that the first processing channel and the second processing channel are implemented "digitally" by the microcontroller and by the DSP, the processing channels could be implemented "in analog manner", each module or filter then being constituted by a plurality of analog components.

Although in the description above, the directional microphone formed by the two external microphones has a first order bidirectional broadside radiation pattern, it is entirely possible to constitute some other type of directional microphone (having a radiation pattern of cardioid, hyper-cardioid, etc. type). It is also entirely possible to use some other number of external microphones, and to partition the space into some other number of sectors.

Although the control device in this example can be used for listening to music, this application is not restrictive in any way, and the control device could perfectly well serve solely for controlling noise, or could be connected to a fixed or mobile telephone and serve to engage in a telephone conversation, etc.

The invention claimed is:

1. An active noise control device comprising two passive attenuation earpieces, each having an external microphone, an internal microphone, and a loudspeaker for playing back a noise into the earpiece; the control device having a first processing channel comprising a feedforward filter connected to the external microphones, a feedback filter connected to the internal microphones, and a playback module supplying each loudspeaker with a playback signal derived from the output signals of the feedforward filter and of the feedback filter; the control device including a second processing channel comprising a sound source identification module for identifying sound sources, the second processing channel being implemented in parallel with the first processing channel and being adapted to adjust the settings of the first processing channel;

wherein the first processing channel includes a partition module for partitioning an external acoustic space, which module is situated upstream from the feedforward filter and makes use of a directional microphone formed by the external microphones in order to partition the external acoustic space into a plurality of incidence sectors;

wherein the identification module is adapted to identify whether an external noise in each incidence sector is a useful noise or an undesirable noise.

2. The control device according to claim 1, wherein the identification module is adapted to adjust the settings of the first processing channel in such a manner that the first processing channel amplifies or forwards unchanged a useful noise coming from a first incidence sector, attenuates strongly an undesirable noise coming from the first incidence sector, and attenuates strongly any noise coming from a second incidence sector.

3. The control device according to claim 1, including adjustment means for selecting the type of useful noise and/or a first incidence sector from among the incidence sectors, and/or a second incidence sector from among the incidence sectors.

4. The control device according to claim 3, including a user interface enabling a user of the control device to control the adjustment means.

5. The control device according to claim 1, wherein the identification module is connected to the feedforward filter and/or to the feedback filter in order to adjust their settings.

* * * * *